US006957902B2

(12) United States Patent
Kim

(10) Patent No.: US 6,957,902 B2
(45) Date of Patent: Oct. 25, 2005

(54) VEHICLE LAMP WITH A SHIELD HAVING A DOUBLE DIRECTIONAL ILLUMINATION STRUCTURE

(75) Inventor: Dong-Su Kim, Daegu (KR)

(73) Assignee: Samlip Industrial Co., Ltd., Daegu (KR)

( * ) Notice: Subject to any disclaimer, the term of this patent is extended or adjusted under 35 U.S.C. 154(b) by 123 days.

(21) Appl. No.: 10/739,945

(22) Filed: Dec. 19, 2003

(65) Prior Publication Data

US 2005/0018442 A1 Jan. 27, 2005

(30) Foreign Application Priority Data

Jul. 23, 2003 (KR) ..... 20-2003-0023775

(51) Int. Cl.[7] ..... F21V 7/00
(52) U.S. Cl. ..... 362/517; 362/304; 362/305
(58) Field of Search ..... 362/539, 517, 362/518, 546, 297, 300, 302, 304, 305, 346, 362/303

(56) References Cited

U.S. PATENT DOCUMENTS 4,587,601 A * 5/1986 Collins ..... 362/235
4,740,871 A 4/1988 Dilouya
4,755,916 A * 7/1988 Collins ..... 362/236
4,912,606 A * 3/1990 Yamamoto ..... 362/518
5,582,480 A * 12/1996 Zwick et al. ..... 362/298
6,558,032 B2 * 5/2003 Kondo et al. ..... 362/516
6,641,293 B2 * 11/2003 Kumar et al. ..... 362/539
6,758,582 B1 * 7/2004 Hsiao et al. ..... 362/302

* cited by examiner

*Primary Examiner*—Thomas M. Sember
(74) *Attorney, Agent, or Firm*—Nixon & Vanderhye P.C.

(57) ABSTRACT

The present invention pertains to a vehicle lamp, comprising: a lamp body in which a first illuminating direction and a second illuminating direction perpendicular to the first illuminating direction are open; an illumination lens for forming a lamp by closing the lamp body and having a first illumination surface through which the light from the light source outgoes to the first illuminating direction, and a second illumination surface through which the light from the light source outgoes to the second illuminating direction; a first reflecting surface for reflecting the light from the light source into the first illuminating direction; a shield for shielding a part of the light proceeded from the light source to the first illuminating direction; and a second reflecting surface formed on the surface facing the light source of the shield, wherein the second reflecting surface reflects and directs the light shielded by the shield into the second illuminating direction. Accordingly, it is possible to provide a vehicle lamp with a shield of a double directional illumination structure that can emit light into a lateral direction without interfering with forward illumination by means of one light source, achieving high light efficiency and maximized spatial utilization.

12 Claims, 3 Drawing Sheets

VEHICLE LAMP WITH A SHIELD HAVING A DOUBLE DIRECTIONAL ILLUMINATION STRUCTURE

This application claims priority to KR Application No. 20-2003-0023775, filed 23 Jul. 2003. The entire contents of this application are incorporated herein by reference.

BACKGROUND OF THE INVENTION

1. Technical Field

The present invention relates to a vehicle lamp of a double directional illumination structure having a light source and a two-directional illumination surface, and more particularly, to a vehicle lamp of double directional illumination structure with a shield, wherein the shield shielding a part of the light emitted forward a first illuminating direction from the light source, and reflecting the shielded light into a second illuminating direction.

2. Description of the Prior Art

Generally, a vehicle comprises lighting equipments, such as vehicle lamps, for the purpose of illumination so that a driver can observe objects better in the case of driving at night, and for the purpose of signaling for notifying another vehicle drivers or walkers of the driver's vehicle state. For example, head lamps or fog lamps are for strong illumination. Turn signal lamps, tail lamps, stop lamps, side markers, etc. are for signaling. Most of the lamps with such various functions are integrally structured in an one lamp assembly called a combination lamp. For example, the combination head lamp provided on the front right and left of a vehicle comprises a high beam head lamp, a low beam head lamp, a turn signal lamp and a tail lamp, etc. The lamp with various functions as described can be configured to comprise several separate illumination surfaces (where the light emitted by a light source or a bulb is directed outside) and corresponding several separate light sources or bulbs, respectively.

The functions of vehicle lamps are increasingly varied nowaday, which results in that the area occupied by the illumination surfaces, thus the size of the combination lamp is relatively large and the number of parts is also great. Consequently, the appearance designs of vehicles are significantly limited, and complexity of the combination lamp increases. Accordingly, for implementing lamp in smaller size, multi-function vehicle lamps in which various functions are integrated have been proposed.

An example of the conventional multi-function lamps is the lamp integrated functionality of a tail lamp/stop lamp and a side marker using an one light bulb. The side marker is legally required in some countries, which is a kind of signaling lamp for indication the vehicle's presence from the lateral direction so that other drivers can visually confirm the existence of the vehicle from the side thereof. In this case, the tail lamp/stop lamp emits light backward from the vehicle (i.e. forward of the lamp) of the vehicle, while the side marker emits light laterally from the vehicle.

For example, the U.S. Pat. No. 4,740,871 discloses a lamp of a double directional illumination structure where one light source emits light into two directions perpendicular to each other. In the disclosed conventional lamp, a part of a reflecting surface that makes the light emitted from a light source directed forward, that is toward a first direction, is altered, so that the light is reflected into a lateral direction, that is a second direction perpendicular to the first direction. The lamp of such a conventional double directional illumination structure emits light through two illumination surfaces perpendicular to each other with an one light source and an altered reflecting surface. Thus the lamp disclosed in U.S. Pat. No. 4,740,871 satisfies the functions of a tail lamp/stop lamp and a side marker simultaneously, whereby implementing performance of various illumination functions with one light source.

By the way, such a conventional lamp does not have a shield structure, wherein the shield structure comprises a shield between the bulb and the forward illumination surface, the shield shielding light from the light bulb so that the light emitted from the bulb can be reflected to reach every corner of the reflecting surface. If the light from the light source is emitted directly toward the front of a vehicle, the light would hinder eyesight of the other drivers in the other vehicles in the opposite direction of the vehicle. In addition, the patterns employed in a lamp reflecting mirror cannot also be well represented since the directly emitting light would blinding other than itself. Therefore, the shield structure is generally employed for a vehicle lamp nowadays.

However, the conventional lamp structure with the altered reflecting surface cannot be easily applied to a lamp with the aforementioned shield structure. Because the shield would interfere the light proceeded from the bulb or from the reflecting surface to the illumination surfaces, even although the reflecting surface is made larger and altered, only smaller amount of light than desired from the bulb or the reflecting surface can reach on the illumination surfaces. Since it is impossible to ensure as much light as desired, using the altered reflecting surface as in the conventional technique, it is not easy to configure a vehicle lamp with the double directional illumination structure having a shield.

Accordingly, there has been a need for implementing a double directional illumination structure for a vehicle lamp having a shield, which can emit light into two directions, for example, perpendicular to each other, using an one light source without any reduced light efficiency.

BRIEF SUMMARY OF THE INVENTION

The invention intends to provide a vehicle lamp of a new double directional illumination structure efficiently configured for the vehicle lamp employing a shield structure, needed as described above.

To this end, it is an object of the invention to provide a vehicle lamp of a new double directional illumination structure in which light can be emitted into two illuminating directions, using a shield structure itself for reflecting light into a second illuminating direction while shielding a part of the light from a light source directed into a first illuminating direction.

It is another object of the invention to provide a vehicle lamp of a double directional illumination structure maximizing light efficiency that can emit light into two illuminating directions, using a shield structure for reflecting the light into a second illuminating direction without interfering in the proceeding of the light from a light source into a first illuminating direction.

And it is still another object of the invention to provide a combination lamp comprising a lamp unit of a double directional illumination structure maximizing light efficiency for a lamp employing the shield structure.

In order to achieve the aforementioned objects, the inventor conceived that a vehicle lamp of a double directional illumination structure while employing a shield structure, can be implemented in a way that, if a shield for shielding the light from a light source directed in a first illuminating direction is configured to reflect the shielded light into a second illuminating direction. In this manner, it is possible to achieve illumination into two directions without affecting light efficiency into the first illuminating direction. That is, for a vehicle lamp employing the shield structure, the inventor found that it is possible to form a reflecting surface for directing the light into desired illuminating directions, using the already existing shield.

In brief, the major feature of the present invention is that the lamp has two different reflecting surfaces which the light emitted from an one light source could be directed into two different illuminating directions, and in particular, is characterized in that a reflecting surface for reflecting the light into the second illuminating direction is formed on the shield, wherein the shield simultaneously shields a part of the light directly proceeding from the light source into the first illuminating direction. In fact, the light shielded by the shield corresponds the light proceeded toward the second illuminating direction.

In one aspect of the invention with aforementioned characteristics, is provided a vehicle lamp with a double directional illumination structure, using a shield which has a reflecting surface. The vehicle lamp comprises: a lamp body in which a first illuminating direction and a second illuminating direction substantially perpendicular to the first illuminating direction are open; an illumination lens for forming a lamp by closing the lamp body and having a first illumination surface through which the light from the light source outgoes to the first illuminating direction, and a second illumination surface through which the light from the light source outgoes to the second illuminating direction; a first reflecting surface for reflecting the light from the light source into the first illuminating direction; a shield for shielding a part of the light proceeded from the light source to the first illuminating direction; and a second reflecting surface formed on the surface facing the light source of the shield, wherein the second reflecting surface reflects and directs the light shielded by the shield into the second illuminating direction.

According to preferred embodiments of the present invention, the shield may directly shield and reflect the light proceeding directly from the light source toward the first illumination surface. The shield may be made of resin that does not transmit visible light, and the second reflecting surface may be coated with a light-reflecting material, preferably aluminum-included coating material.

The second reflecting surface may be formed to have a plurality of separate focusing surfaces.

The light source may be placed at a common focus shared by the first reflecting surface and the second reflecting surface.

Also, the first illumination surface and the second illumination surface of the illumination lens may be an integrally formed part.

Furthermore, the present invention provides a combination lamp comprising a vehicle lamp with the aforementioned structure, wherein the light directed by the second reflecting surface into the second illuminating direction functions as a side marker.

BRIEF DESCRIPTION OF THE DRAWINGS

The benefits and advantages of the present invention will become more readily apparent to those skilled in the art after reviewing the following detailed description and accompanying drawings, wherein.

DETAILED DESCRIPTION OF THE PREFERRED EMBODIMENT

Figure 1:
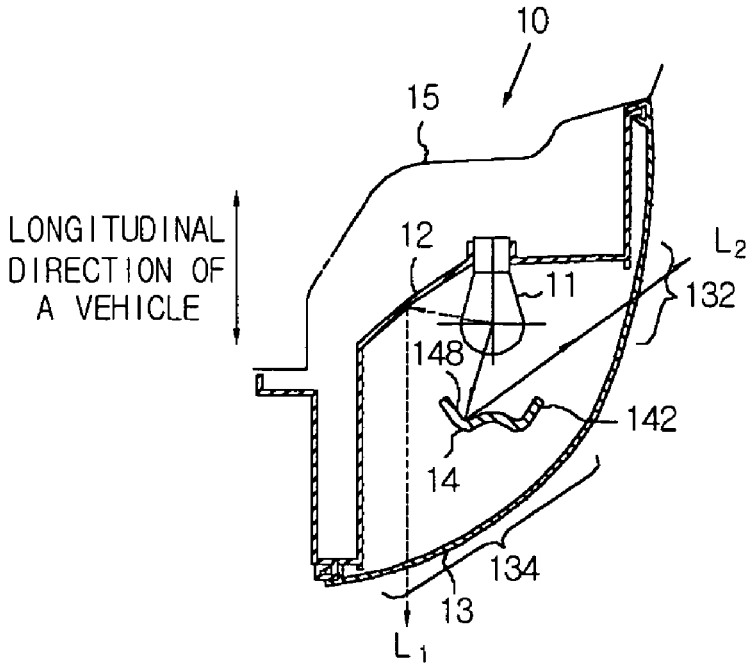
FIGS. 1 and 2 show schematically the structure of a vehicle lamp having a double directional illumination structure according to one embodiment of the invention.
Figure 2:
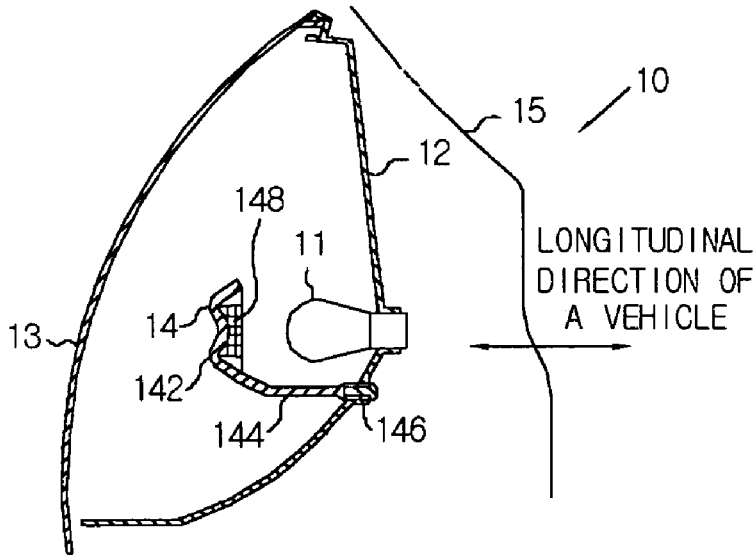

FIGS. 1 and 2 represent a vehicle lamp 10 having a double directional illumination structure according to a preferred embodiment of the invention. The lamp 10 comprises a light source 11 and a substantially parabola-shaped reflecting surface 12 in the lamp space. The lamp space is defined by a lamp body 15 and an illumination lens 13. The lamp 10 according to the present invention is further provided with a shield 14 for shielding the light directly proceeding from the light source 11 toward the front of the lamp 10. If the reflecting surface 12 of the lamp 10 is formed with a specific pattern, the light reflected by the reflecting surface 12 with the pattern and the light emitted directly from the light source 11, are recognized at the front of the lamp 10, that is from outside of the illumination lens 13, by other drivers or walkers. In this case, the light directly emitted from the light source 11 causes glare, and thus degrades the light pattern reflected in the specific pattern of the reflecting surface 12. The shield 14 serves to clear the pattern images of the reflecting surface 12 by shielding the direct light from the light source 11. Such a lamp-with-shield structure is generally employed into a reflecting mirror-type vehicle lamp.

The lamp 10 according to the invention is characterized in that the shield 14 is provided with a second reflecting surface 148 for reflecting the light from the light source 11, which will be more detailed hereinafter.

In the lamp 10 according to the invention, the light from an one light source is directed into two different illuminating directions. Two illuminating directions may comprise a first illuminating direction, for example, the front which is one of the longitudinal direction (indicated by an arrow in FIG. 4), and a second illuminating direction, for example, the direction perpendicular to the longitudinal direction of the vehicle, namely the side or lateral direction.

The lamp body 15 is shaped whose first illuminating direction, that is the front, and second illuminating direction, that is the side of the vehicle, are open. The open portions of the lamp body 15 are closed by the illumination lens 13. The illumination lens 13 may be made of, for example, transparent glass for protecting the inside space of the lamp 10, and serves as an exit through which the light from the light source 11 can be proceeded toward the front and the side directions. The illumination lens 13 has a first illumination surface 134 for illuminating the front direction and a second illumination surface 132 for illuminating the side direction. The two illumination surfaces of the illumination lens 13 are preferably connected and formed in an integral body or part.

Although a separate reflecting element or refracting element is not included in the illumination lens 13 for the illustrated example, but this element could be added if required, so that the emitted light could be properly dispersed or deflected in desired directions.

According to the present invention, the light directed toward the front illumination surface 134 and the lateral illumination surface 132 of the illumination lens 13 is not came directly from the light source 11, but came indirectly after reflected by the two different reflecting surfaces 12 and 148, respectively. That is, the first reflecting surface 12 is formed around the light source 11. The first reflecting surface 12 reflects the light L1 from the light source 11 into the first illuminating direction, that is toward the front of the vehicle lamp. The second reflecting surface 148 is formed on the light shielding part 142 of the shield 14. The second reflecting surface 148 shields the light emitted directly from the light source 11 toward the front direction while simultaneously reflects all or at least a part of the shielded light L2 into the second illuminating direction, that is the lateral direction.

More particular, the second reflecting surface 148 is formed on the surface facing with the light source 11. One end 146 of the shield 14 is fixed to the lamp body 15 or the reflecting surface 12 by, for example, a fastener such as screw fixed at around the light source 11. From this end 146, a support 144 slightly longer than the length of the light source 11 is extended and protruded toward inside of the lamp space. The other end of the shield 14 is a light shielding portion 142 formed in, for example, a dish shape and arranged to shield the light source 11 against the front direction. The second reflecting surface 148 may be formed on the surface facing the light source 11 on the dish-shaped light-shielding portion 142.

Figure 3:
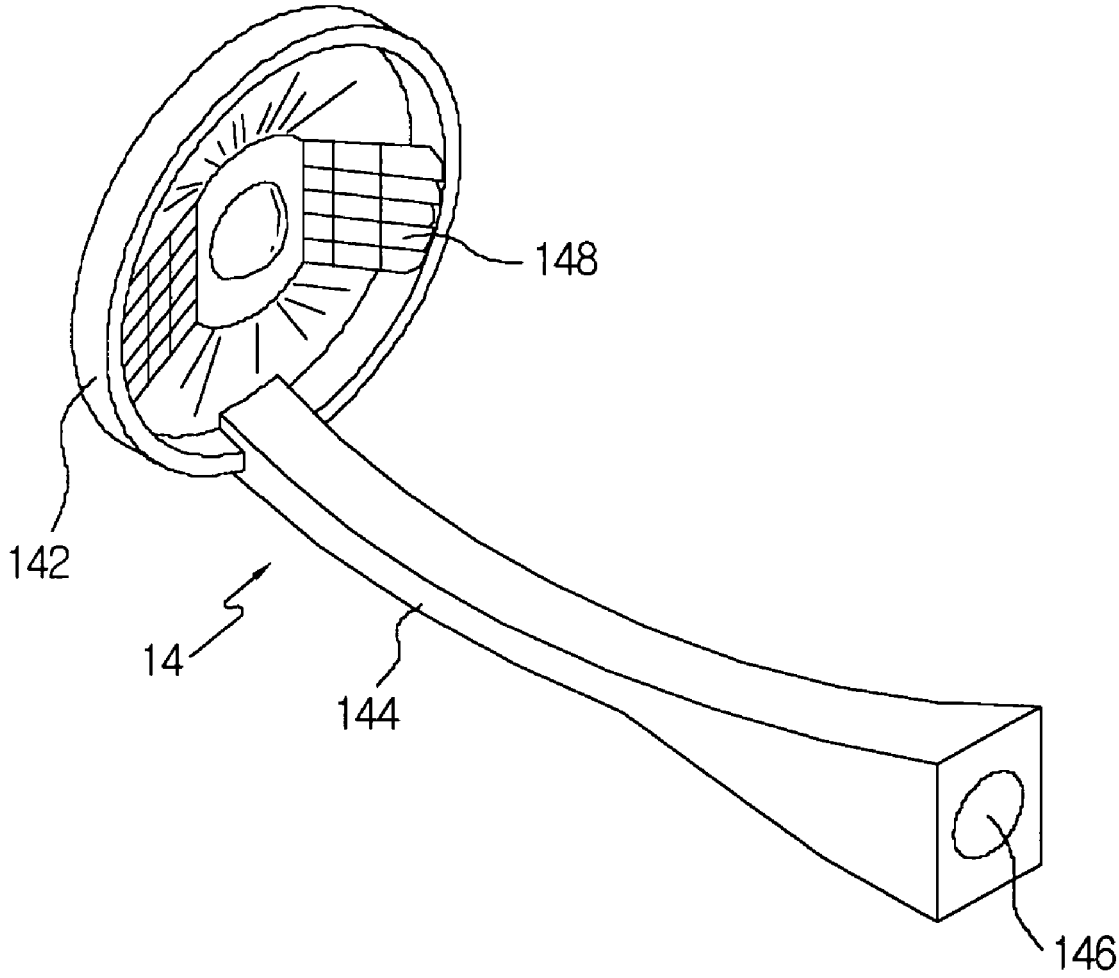
FIG. 3 is a perspective view showing only the shield in FIG. 2.

The reflecting surface 148 of the shield 14 may be an one smoothly rounded surface. Alternatively and preferably, the reflecting surface 148 may be formed to have a number of partial reflecting surfaces. Each of the partial reflecting surfaces may have a separate focus, as shown in FIG. 3. The plurality of separately focusing partial reflecting surfaces allow the reflected light to be easily refracted into a desired direction as compared to a simple one reflecting surface, which may achieve better design pattern images because the reflected light would be formed a pattern image as defined by the arrangement of the partial reflecting surfaces.

As in the conventional reflecting mirror type lamp, the light source 11 may be located on the focus of the first general parabola-shaped reflecting surface 12. In the present invention, the light source or bulb 11 may be also at a focus of the second reflecting surface 148. In another words, the bulb 11 may be at a common focus of the first and the second reflecting surfaces 12 and 148. In this case, it is possible to direct the light toward the side direction to proceed in parallel. For this purpose, the plurality of partial reflecting surfaces consisting of the second reflecting surface 148 could be shaped to be a parabola surface in its entirety. Then the second reflection surface 148 could be place such that the focus of the resulted parabola surface and the focus of the first reflecting surface 12 may be at the same location.

In addition, as shown in the FIG. 3, the reflecting surface 148 of the shield 14 may be formed, using only a part of the dish-shaped light-shielding portion 142 that can reflect the light into a lateral direction.

The shield 14 may be integrally formed into an one part with, for example, non-transmissible resin through which visible light cannot transmitted. The reflecting surface 148 may then be coated with a material of a desired light reflectance. Preferably, the reflecting surface 148 may be, for example, aluminum-coated. In case of aluminum coating, it is possible to apply the conventional shield manufacturing process in which the applying aluminum coating onto the non-transmissible resin is employed. Thus it is advantageous that a separate process is not necessarily required. Of course, the coating material for the reflecting surface is not necessarily aluminum for the invention. It will be apparent to those skilled in the art that any material of a desired reflectance, such as white paint, may be applied.

Figure 4:
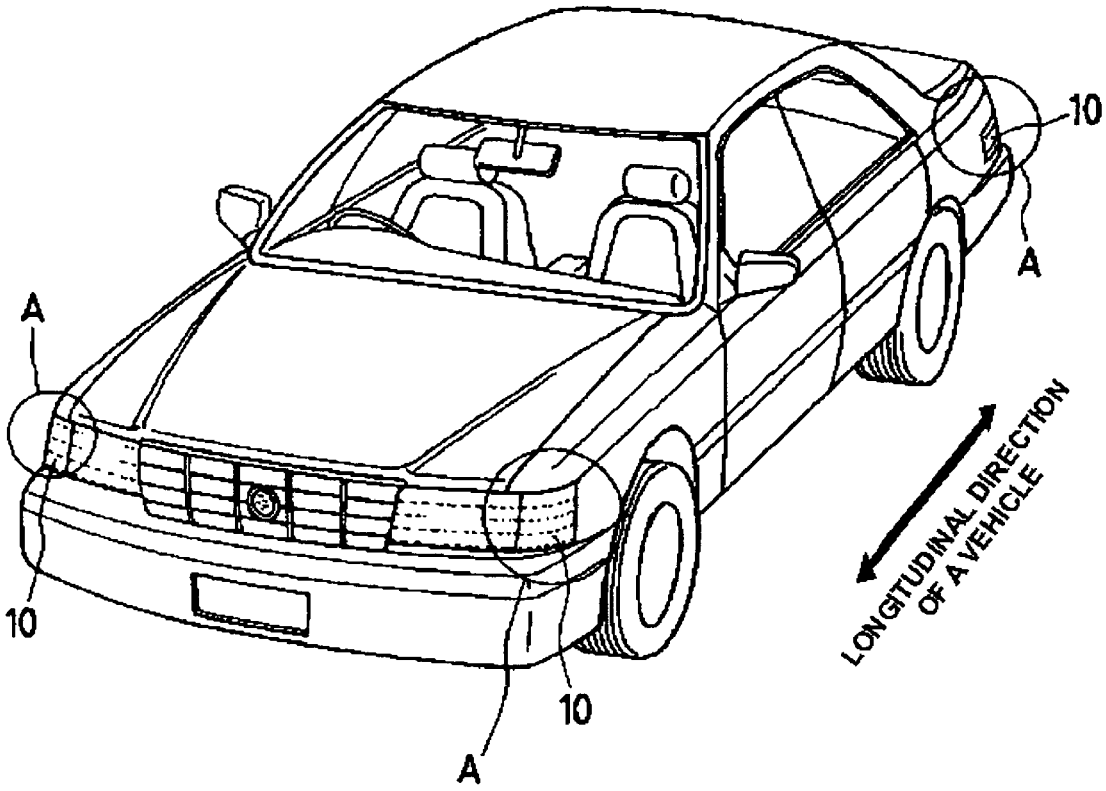
FIG. 4 represents schematically an example of a vehicle lamp equipped on a vehicle, having the double directional illumination structure according to one embodiment of the invention.

With reference to FIG. 4, in another aspect of the invention, a vehicle lamp 10 with the aforementioned configuration is shown to be equipped as a part of a head or rear combination lamp. In particular, the lamp 10 of the double directional structure according to the invention can emit light into the longitudinal direction of the vehicle and into the lateral direction perpendicular to the longitudinal direction at the same time. Accordingly, as shown in FIG. 4, the lamp 10 is equipped at the corner A of the vehicle, can illuminate forward (in case of a head lamp) or backward (in case of the rear lamp), toward the side, that is the lateral direction of the vehicle, at the same time. In this case, the light directed by means of the second reflecting surface 148 formed on the shield 14 may be used as a side marker lamp for indicating the lateral location of the vehicle.

Hereinabove, a reflecting mirror type lamp to which a double directional illumination structure according to the invention is applied was described, but the present invention shall not be limited to such a reflecting-mirror type. Since the characteristics of the invention are to form a second reflecting surface by which light is reflected into a second illuminating direction, using a shield, the present invention may be applied to any lamp structure with a shield, for example, the projection lamp structure with a shield.

Therefore, since those skilled in the art can easily understand that the spirit of the invention is not limited to the specific embodiment illustrated and various modifications and changes can be made to the invention without departing from the true spirit and scope of the present invention, and within the scope claimed in the accompanying claims, it should be noted that the invention should be interpreted by the scope of the claims of the accompanying claims.

What is claimed is:

1. A vehicle lamp comprising:

a lamp body, a first illuminating direction and a second illuminating direction substantially perpendicular to the first illuminating direction thereof being open;

an illumination lens for forming a lamp by closing the lamp body and having a first illumination surface through which the light from the light source outgoes to the first illuminating direction, and a second illumination surface through which the light from the light source outgoes to the second illuminating direction;

a first reflecting surface for reflecting the light from the light source into the first illuminating direction;

a shield for shielding a portion of the light proceeding from the light source into the first illuminating direction, wherein the shield includes a second reflecting surface formed on the surface facing the light source, the second reflecting surface reflecting the light shielded by the shield to direct the light into the second illuminating direction.

2. The vehicle lamp as claimed in claim 1, wherein the shield is made of resin which is not transmitting visible light, and the second reflecting surface 148 is coated with a light-reflecting material.

3. The vehicle lamp as claimed in claim 2, wherein coated material for the second reflecting surface comprises aluminum.

4. A combination lamp for a vehicle, comprising the vehicle lamp as claimed in claim 3, wherein the light proceeding to the second illuminating direction by the second reflecting surface functions as a side marker.

5. A combination lamp for a vehicle, comprising the vehicle lamp as claimed in claim 2, wherein the light proceeding to the second illuminating direction by the second reflecting surface functions as a side marker.

6. The vehicle lamp as claimed in claim 1, wherein the second reflecting surface is formed to have a plurality of separate focusing surfaces.

7. A combination lamp for a vehicle, comprising the vehicle lamp as claimed in claim 6, wherein the light proceeding to the second illuminating direction by the second reflecting surface functions as a side marker.

8. The vehicle lamp as claimed in claim 1, wherein the light source is placed at a common focus shared by the first reflecting surface 12 and the second reflecting surface 148.

9. A combination lamp for a vehicle, comprising the vehicle lamp as claimed in claim 8, wherein the light proceeding to the second illuminating direction by the second reflecting surface functions as a side marker.

10. The vehicle lamp as claimed in claim 1, wherein the first illumination surface and the second illumination surface are formed as an integrated part.

11. A combination lamp for a vehicle, comprising the vehicle lamp as claimed in claim 10, wherein the light proceeding to the second illuminating direction by the second reflecting surface functions as a side marker.

12. A combination lamp for a vehicle, comprising the vehicle lamp as claimed in claim 1, wherein the light proceeding to the second illuminating direction by the second reflecting surface functions as a side marker.

* * * * *